US007938624B2

(12) United States Patent
Tibbott

(10) Patent No.: US 7,938,624 B2
(45) Date of Patent: May 10, 2011

(54) COOLING ARRANGEMENT FOR A COMPONENT OF A GAS TURBINE ENGINE

(75) Inventor: Ian Tibbott, Litchfield (GB)

(73) Assignee: Rolls-Royce PLC, London (GB)

( * ) Notice: Subject to any disclaimer, the term of this patent is extended or adjusted under 35 U.S.C. 154(b) by 937 days.

(21) Appl. No.: 11/889,709

(22) Filed: Aug. 15, 2007

(65) Prior Publication Data

US 2008/0063524 A1 Mar. 13, 2008

(30) Foreign Application Priority Data

Sep. 13, 2006 (GB) ..... 0617992.3

(51) Int. Cl.
*F01D 25/12* (2006.01)

(52) U.S. Cl. ..... 416/96 R; 415/115; 415/178

(58) Field of Classification Search ..... 415/115, 415/178; 416/96 R, 97 R; 60/752
See application file for complete search history.

(56) References Cited

U.S. PATENT DOCUMENTS

| | | | | |
|---|---|---|---|---|
| 3,844,678 | A | 10/1974 | Sterman et al. | |
| 4,297,077 | A * | 10/1981 | Durgin et al. | 416/97 R |
| 5,533,864 | A | 7/1996 | Nomoto et al. | |
| 6,234,754 | B1 | 5/2001 | Zelesky et al. | |
| 6,318,963 | B1 * | 11/2001 | Emery et al. | 416/96 A |
| 6,708,499 | B2 * | 3/2004 | Pidcock et al. | 60/796 |
| 7,258,528 | B2 * | 8/2007 | Trindade et al. | 416/96 A |
| 7,303,376 | B2 * | 12/2007 | Liang | 416/96 R |
| 2002/0085908 | A1 | 7/2002 | Tiemann | |

FOREIGN PATENT DOCUMENTS

| | | |
|---|---|---|
| EP | 1 314 855 A3 | 5/2003 |
| EP | 1 505 257 A2 | 2/2005 |
| GB | 723394 | 2/1955 |
| GB | 895077 | 5/1962 |

* cited by examiner

*Primary Examiner* — Ninh H Nguyen
(74) *Attorney, Agent, or Firm* — Oliff & Berridge, PLC

(57) ABSTRACT

A component, such as a blade, vane or combustor wall of a gas turbine engine comprises two walls defining a coolant passage and has an array of pedestals extending between the two walls for heat removal. Each pedestal changes in cross-section along its length. Alternate rows of pedestals are arranged such that their larger cross-sectional area is adjacent one wall then the other. When a coolant flows through the passage it is forced to flow between one wall and the other wall so as to increase turbulence and hence mixing for a more even coolant temperature. The array of pedestals can also be used to tailor the individual heat loads on each wall independently and has the ability to use differing levels of blockage to counter adverse pressure gradients along successive rows of pedestals.

20 Claims, 5 Drawing Sheets

COOLING ARRANGEMENT FOR A COMPONENT OF A GAS TURBINE ENGINE

This invention relates to cooling arrangements for walls of heated components particularly but not exclusively in aerofoils, such as blades and vanes, and combustor walls used in gas turbine engines.

The performance of a gas turbine engine cycle, whether measured in terms of efficiency or specific output, is improved by increasing turbine gas temperatures. It is therefore desirable to operate the turbine at the highest possible temperature. For any engine cycle compression ratio or bypass ratio, increasing the turbine entry gas temperature, will always produce more specific thrust (e.g. engine thrust per unit of air mass flow). However as turbine entry gas temperatures increase, the life of an uncooled turbine component reduces, necessitating the development of more durable materials and/or the introduction of parasitic internal fluid cooling.

In modern engines, the high pressure (HP) turbine gas temperatures are now much hotter than the melting point of the blade materials used and therefore they require substantial quantities of cooling air. In some engine designs the intermediate pressure (IP) and low pressure (LP) turbines also require cooling.

Internal convection and external cooling films are the prime methods of cooling the aerofoils. HP turbine nozzle guide vanes (NGVs) consume the greatest amount of cooling air on high temperature engines. HP blades typically use about half of the NGV flow. The IP and LP stages downstream of the HP turbine use progressively less cooling air.

Turbine blades and vanes are cooled by using air from the HP or IP compressor that has by-passed the combustor and is therefore relatively cool compared to the main gas flow temperature. Typical cooling air temperatures are between 700 and 900 K and main working gas flow temperatures can be in excess of 2100 K. Extracting coolant flow therefore has an adverse effect on the engine operating efficiency. It is thus important to use this cooling air as effectively as possible.

Typically, cooled turbine components make optimum use of the coolant by maximising heat extraction, while minimising pressure drop needed to drive the coolant flow. Cooled components therefore employ intricate cooling passage networks and heat transfer augmentation devices, which can be cast into the walls of the components that are subject to particularly hot gases. These augmentation devices promote heat transfer by rendering the internal flow to be turbulent and by mixing the coolant in contact with the hot walls with the cooling flow.

One such augmentation device comprises an array of pedestals 34 cast on to internal walls 32, 33 of an aerofoil 30 as shown in FIG. 2. Conventionally, these pedestals are arranged either in an 'in-line' 34*a* or a 'staggered' 34*b* configuration (FIGS. 3 and 4 respectively) with respect to the direction of the cooling flow. Each pedestal 34 produces a pair of 'horse shoe' shaped vortices 36 in the flow immediately downstream of the pedestal. These vortices 36 promote heat transfer on the adjacent walls 32, 33. High levels of heat transfer are also produced on the leading edges 38 of the pedestals 30 and in the wake regions (36) where a local boundary layer becomes thinned. In these conventional arrangements 34*a*, 34*b* the heat transfer levels produced are similar on both adjacent internal surfaces 32*i*, 33*i*. This can be a limitation when one surface requires greater heat transfer than the other in order to achieve a constant temperature of the aerofoil 30. Uneven (wall material) temperatures give rise to undesirable thermal gradients that can cause excessive thermal stresses in the aerofoil or other component, which can subsequently lead to premature component failure through low cycle thermal fatigue. In general, although a reasonable degree of mixing occurs as the flow moves downstream through the pedestal array, the fluid on inner surface 32*i* of wall 32 is not significantly mixed with the fluid on inner surface 33*i* of wall 33. Thus there can be a significant difference in temperatures of the two opposing walls 32, 33 causing low cycle thermal fatigue.

The object of the present invention is therefore to maintain a more constant temperature between opposing end walls of a heated component within a gas turbine engine, reducing the thermal gradient and increase the life of the aerofoil or other engine components.

According to the invention, there is provided a component for a gas turbine engine (10) comprising two walls defining a coolant passage and an array of pedestals extending between the two walls characterised in that at least one pedestal changes in cross-section between one wall and the other wall.

In one embodiment, the pedestal(s) tapers.

Preferably, the pedestal(s) comprises a first part having a first cross-sectional area and a second part having a second cross sectional area.

Preferably, the first cross-sectional area is greater than the second cross sectional area.

Preferably, the first part and the second part are concentric.

Alternatively, the first part and the second part are aligned at a common leading edge.

Alternatively, the first part and the second part are aligned at a common trailing edge.

Normally, in a first row of pedestals at least two of the pedestals have their greater cross sectional area adjacent the first wall.

Alternatively, in a second row of pedestals at least two of the pedestals have their greater cross sectional area adjacent the second wall.

Preferably, an array of pedestals comprises alternating first and second rows of pedestals.

Alternatively, in a first row of pedestals at least two of the pedestals alternate between having their greater cross sectional area adjacent the first wall and their smaller cross sectional area adjacent the first wall. In a second row of pedestals at least two of the pedestals alternate between having their greater cross sectional area adjacent the second wall and their smaller cross sectional area adjacent the second wall.

Preferably, the first and second rows are offset from one another so that in the downstream direction of the coolant the greater cross sectional area alternates between adjacent the first wall and the second wall.

Alternatively, the pedestals in the first row are in-line with the second row of pedestals with respect to the direction of coolant flow.

Alternatively, the pedestals in the first row are staggered with respect to the second row of pedestals with respect to the direction of coolant flow.

In another aspect of the present invention, the wall defines a hole for the passage of coolant therethrough and at least one adjacent pedestal is arranged such that its smaller cross-sectional area part is adjacent the hole.

Preferably, the smaller cross-sectional area part is positioned away from the hole, offset from the larger cross-sectional area part.

Preferably, the two parts of each pedestal are selected from the group comprising the cross-sectional shapes of circular, triangular, rectangular, diamond, parallelepiped, and ellipse.

Preferably, the two parts have the same cross-sectional shape.

Alternatively, the two parts have different cross-sectional shapes.

Alternatively, a second axis of one part is not aligned with a second axis of the other part.

Preferably, the component is a blade or vane of a turbine or a compressor of a gas turbine engine.

Alternatively, the component is a wall of a combustor of a gas turbine engine.

Embodiments of the invention will now be described by way of example only, with reference to the accompanying diagrammatic drawings, in which:—

Figure 9:
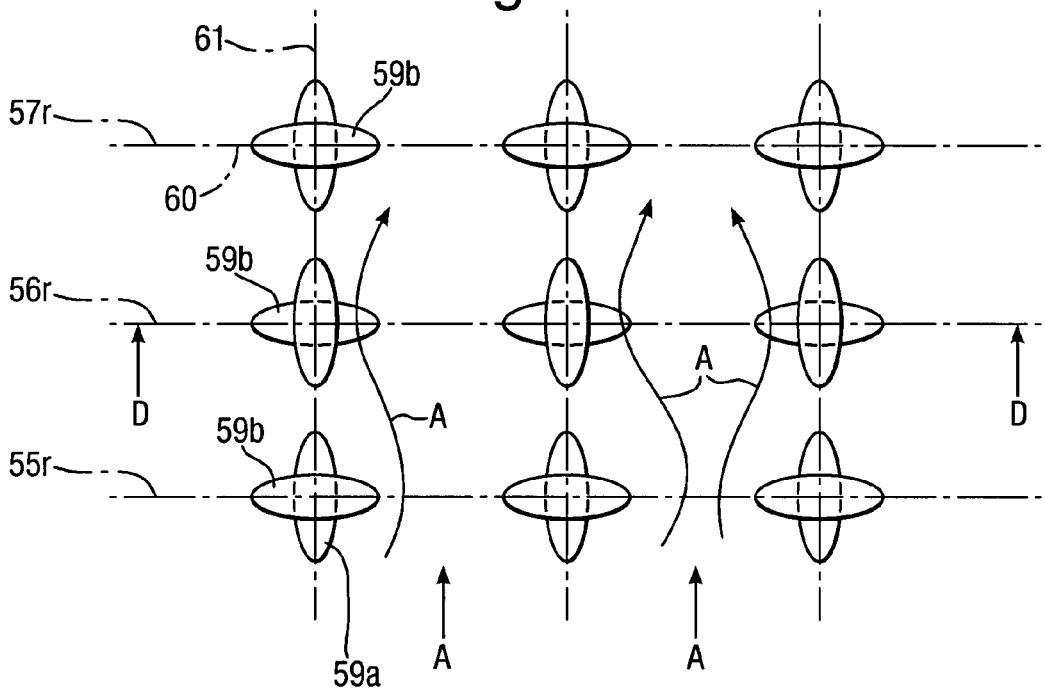
Figure 10:
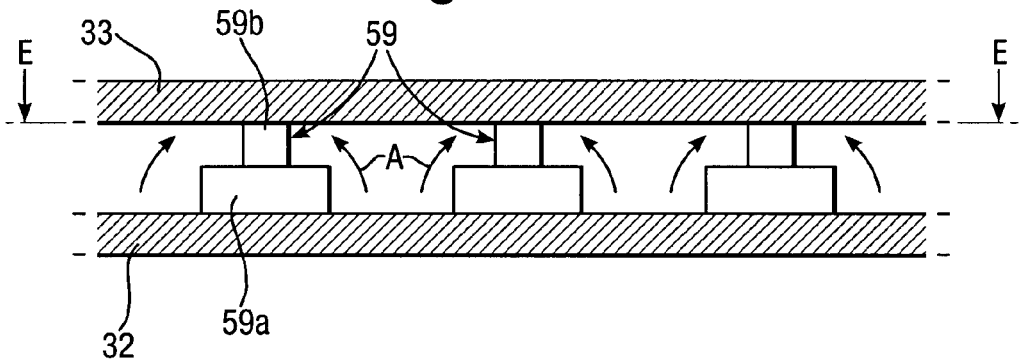
Figure 11:
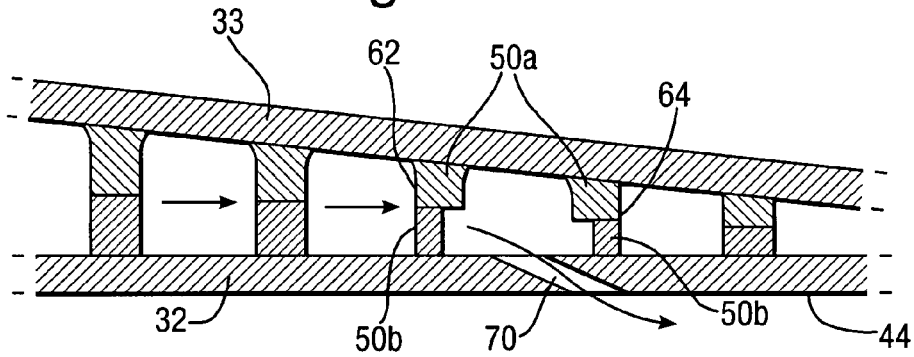

FIGS. 8*a*-8*f* are plan view views on alternative pedestal shapes in accordance with the present invention;

FIG. 9 is a view on section A-A (and E-E in FIG. 6) showing a second embodiment of an array of pedestals in accordance with the present invention;

FIG. 10 is a view on section D-D in FIG. 8 showing the second embodiment of the present invention;

FIG. 11 is a part section through a turbine blade in accordance with a third embodiment of the present invention.

Figure 1:
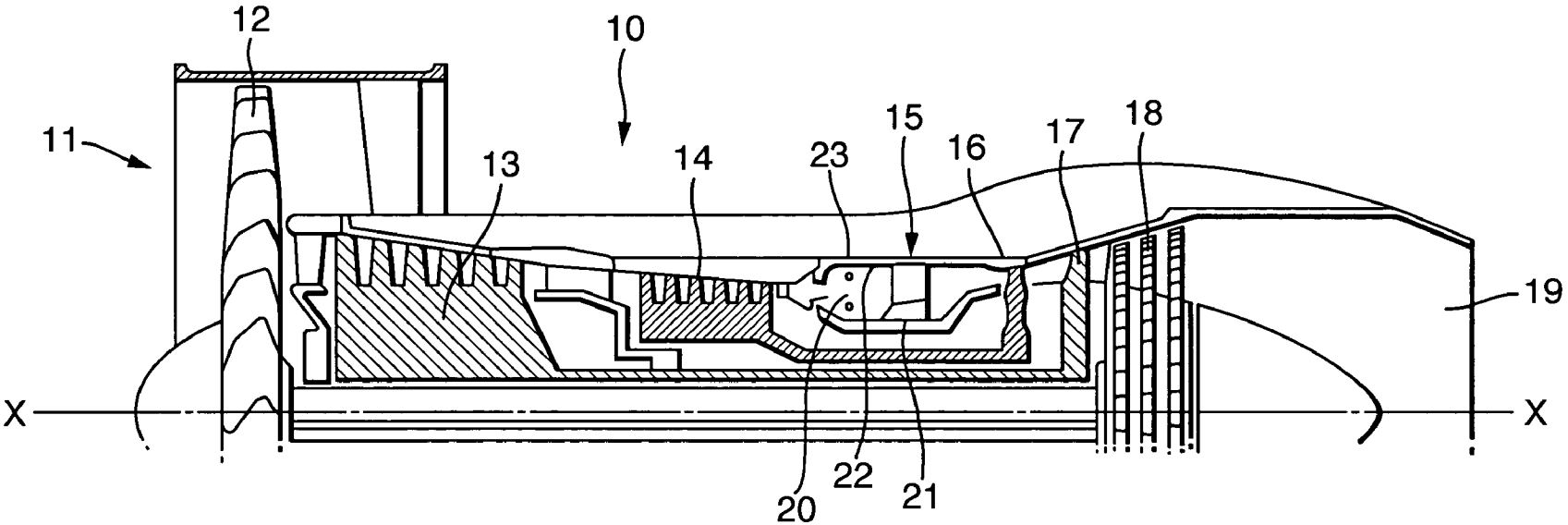
FIG. 1 is a sectional side view of a gas turbine engine.
Figure 2:
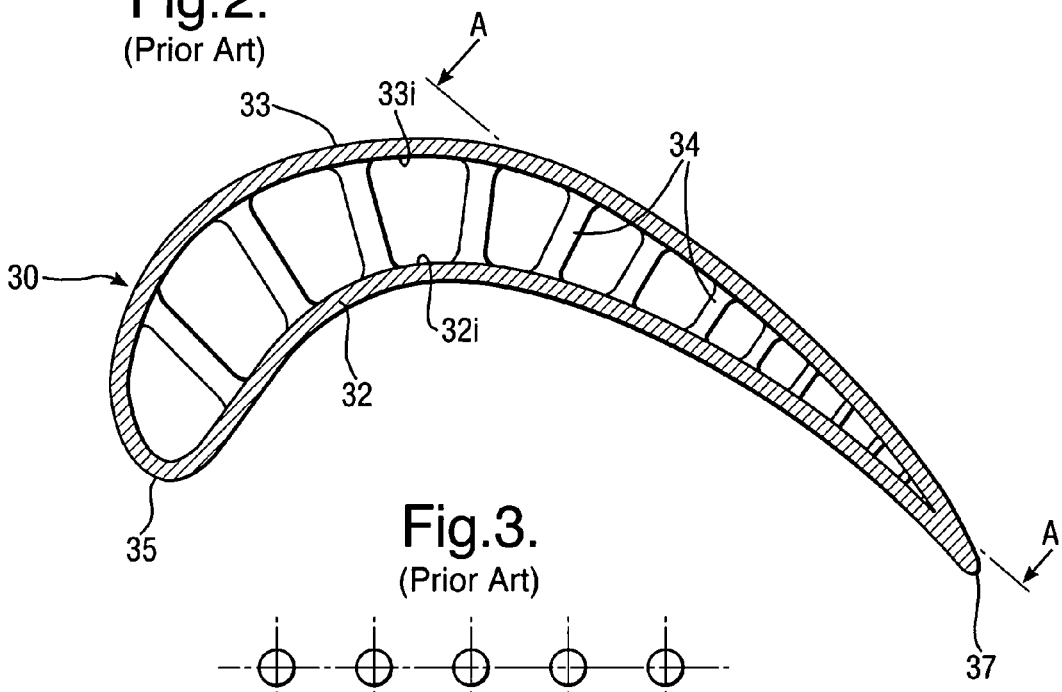
Fig.2. (Prior Art)
FIG. 2 is a section through a prior art turbine blade.
Figure 3:
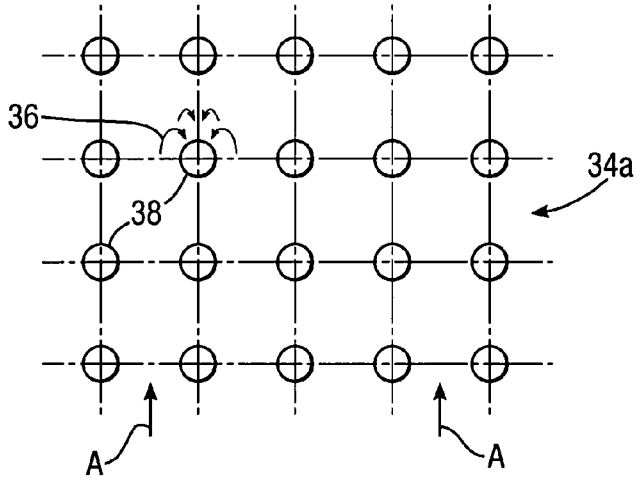
Fig.3. (Prior Art)
FIG. 3 is a view on section A-A in FIG. 2 showing a first prior art array of pedestals.

With reference to FIG. 1, a gas turbine engine is generally indicated at 10 and comprises, in axial flow series, an air intake 11, a propulsive fan 12, an IP compressor 13, an HP compressor 14, combustion equipment 15, a HP turbine 16, an IP turbine 17, an LP turbine 18 and an exhaust nozzle 19.

The gas turbine engine 10 works in the conventional manner so that air entering the intake 11 is accelerated by the fan to produce two air flows: a first air flow into the IP compressor 13 and a second air flow which provides propulsive thrust. The IP compressor 13 compresses the air flow directed into it before delivering that air to the HP compressor 14 where further compression takes place.

The compressed air exhausted from the HP compressor 14 is directed into the combustion equipment 15 where it is mixed with fuel and the mixture combusted. The resultant hot combustion products then expand through, and thereby drive, the HP, IP and LP turbines 16, 17 and 18 before being exhausted through the nozzle 19 to provide additional propulsive thrust. The HP, IP and LP turbines 16, 17 and 18 respectively drive the HP and IP compressors 14 and 13 and the fan 12 by suitable interconnecting shafts.

Figure 4:
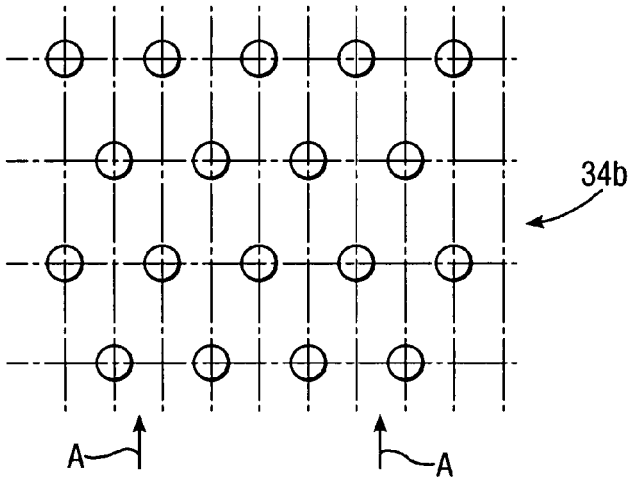
Fig.4. (Prior Art)
FIG. 4 is another view on section A-A in FIG. 2 showing a second prior art array of pedestals.
Figure 5:
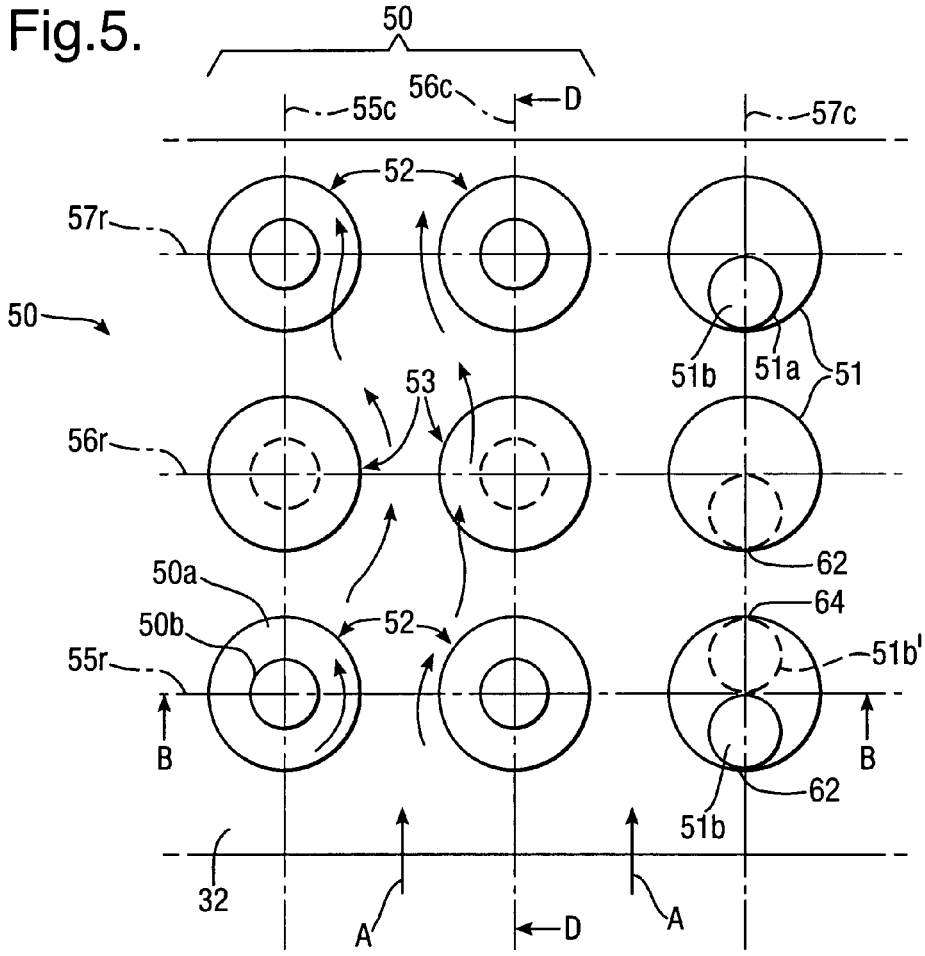
FIG. 5 is a view on section A-A in FIG. 2 (and C-C in FIG. 6) showing a first embodiment of an array of pedestals in accordance with the present invention.
Figure 6:
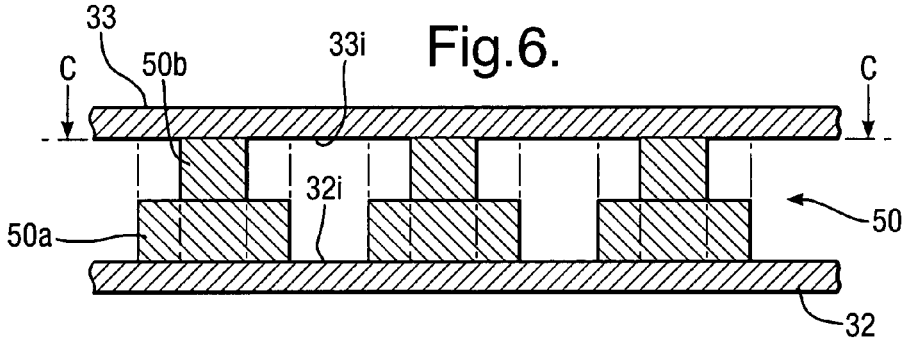
FIG. 6 is a view on section B-B in FIG. 5 showing the first embodiment of the present invention.
Figure 7:
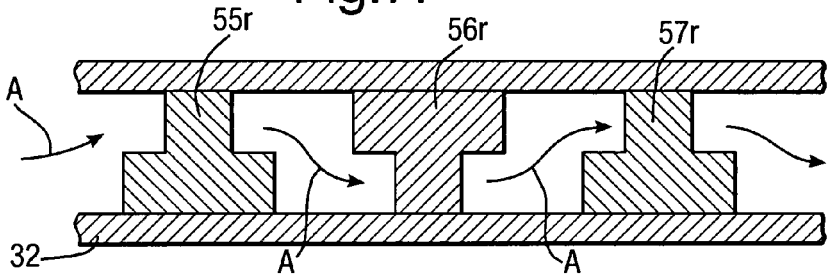
FIG. 7 is a view on section D-D in FIG. 5 showing the first embodiment of the present invention.

Referring now to FIGS. 5, 6 and 7, which show an array of pedestals 50 of a first embodiment of the present invention. The array of pedestals 50 is situated in a turbine blade 30 similar to the one shown in prior art FIG. 4. The turbine blade 30 is one of an annular array of radially extending blades of a stage of the HP turbine 16 and comprises a pressure side wall 32 and a suction side wall 33, joined together at the blades leading and trailing edges 35, 37 and via the pedestals 50.

The blade 30 and pedestals 50 are usually produced by the known lost wax casting process, which includes casting metal around a ceramic core in which the pedestals have been formed by pins introduced into the walls of a ceramic core die. Normally, the core die opens and closes along a central split line with half of each pedestal produced in one half of the die and the other half produced in the other half. The two halves of the core die thus produce the part-pedestals 50*a*, 50*b* in the two adjoining wall halves 32 and 33 respectively. During the casting process the metal fuses to produce one complete or integral pedestal 50.

Pedestals 34 in conventional blade halves have the same geometric shape, diameter and co-axial centre-line location. For the present invention the blade or component is manufactured in the same manner, but each wall 32, 33 halve comprises part-pedestals 50*a*, 50*b* having different diameters, as in this embodiment, or cross-sectional areas. For the present invention, the array of pedestals 50 may be in any conventional pattern such as in-line or staggered and usually with respect to the general direction of coolant flow.

Each pedestal 50 of the present invention comprises a variation in cross-sectional area between the walls 32, 33. In the first embodiment the pedestals 50 comprise two parts of different diameters 50*a*, 50*b* and which are arranged substantially coaxial. However, the centres of the pedestal parts 51*a*, 51*b* do not necessarily need to be coaxial and for example either their leading edges 62 or trailing edges 64 may be aligned. The pedestals in rows 55*r* and 57*r* (row 55*r* is shown in FIG. 6) comprise a larger cross-sectional area part 50*a* adjacent the wall 32 and the smaller cross-sectional are part 50*b* adjacent the wall 33. These pedestals, which reduce in cross-sectional area from wall 32 are designated 52. In row 56*r* the pedestals 50 comprise the larger cross-sectional area part 50*a* adjacent the wall 33 and the smaller cross-sectional are part 50*b* adjacent the wall 32. These pedestals, which reduce in cross-sectional area from wall 32 are designated 53. The complete array of pedestals 50 in a blade or other component has further alternating rows of pedestals 55*r*, 56*r*, 57*r* arranged sequentially and generally in direction of the coolant flow therethrough.

This and the other arrangements of pedestals 50, 51 described herein change the shape of the coolant flow passage 49 between the walls 32, 33 and as the cooling fluid A passes along the passage 49 it is forced to flow from one wall to the other as it passes through each row of pedestals. Thereby mixing of the coolant is improved and provides a more even overall heat flux and attains a more desirable thermal profile throughout the component and its walls. Essentially, the arrangement of pedestals 50 forces the coolant to flow in a three dimensional regime rather than for the known pedestal arrays in two dimensions. As seen in FIGS. 5, 6 and 7 the coolant flow A is made to not only to zig-zag around the pedestals but also to zig-zag between the surface 32*i* and the surface 33*i* as the flow passes in a general downstream direction. This new cooling gas flow path promotes higher levels of turbulence and therefore improved mixing as heat transfers into the coolant near each wall. Thus the relatively hotter air flowing over the hotter pressure side wall 32 is mixed with the relatively cooler air flowing over the cooler wall 33, which does not require so much heat removal. Thus the thermal gradient within each wall 32, 33 and between pressure wall 32 and suction wall 33 is minimised and the life of the blade or other component increased.

It should be appreciated by the skilled artisan that the pedestals may be spaced and pitched differently to that shown. For example within each row 55*r*, 56*r*, 57*r* the pedestals may be spaced and pitched to preferentially cool certain parts of the component or placed around other features of the component. In addition or alternatively, the cross-sectional areas of the pedestals may be different depending on the desired cooling regime and component configuration. More pedestals may be positioned where for additional cooling is required. The ratio of cross-sectional areas between the parts 50*a*, 50*b* of each pedestal may be varied again for preferential cooling of one wall to the other, or to force greater cross-wall turbulance. Variable pitching of the pedestals or rows of pedestals 50 can also be used to promote different levels of 'blockage' and turbulence and therefore improve heat removal and mixing within the coolant flow. This technique can be used as a tool to prevent internal flow migration in the presence of an adverse pressure gradient at either the coolant's entry or exit of the pedestal arrays. With respect to these modifications, the teachings of the pedestal arrangements in the Applicant's co-pending applications GB0601412.0, GB0601413.8, GB0601418.7 and GB0601438.5 are incorporated herein without departing from the scope of the present invention.

In a further modification of this first embodiment, pedestals 50 in each row 55, 56, 57 alternate between a pedestal with the larger cross-sectional area part 50*a* adjacent the wall 32 and the next pedestal having the larger cross-sectional area part 50*a* adjacent the wall 33 and so on. The sequentially adjacent rows 56 are offset from one another such that the larger cross-sectional area part 50*a* in one row is downstream of the smaller cross-sectional part 50*b* in an upstream row 55. This modification may also be extended where pairs, triple or other multiples of adjacent pedestals within each row are arranged to alternate between the larger cross-sectional area part 50*a* adjacent the wall 32 and the next multiple of pedestals having the larger cross-sectional area part 50*a* adjacent the wall 33 and so on.

Furthermore, each half pedestal 50*a,b*, 51*a,b* may be of a different shape and chosen from the group comprising an ellipse, square, triangular, diamond or any other polygon some of which are shown in FIGS. 8*a-d*. Polygonal shapes having edges or corners induce stronger and/or more vortices and can enhance mixing, however, they also induce a greater pressure loss to the coolant flow. The use of polygonal shapes may therefore be used locally around hot spots in on the walls 32, 33, 21. The two parts (50*a*, 51*a*, 53*a*, 50*b*, 51*b*, 53*b*) of the pedestal may have different cross-sectional shapes.

Figure 8A:
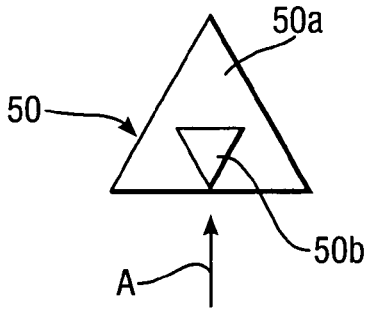
Figure 8B:
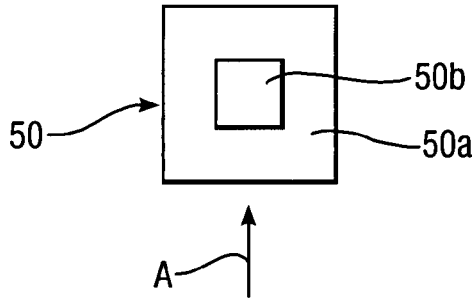
Figure 8C:
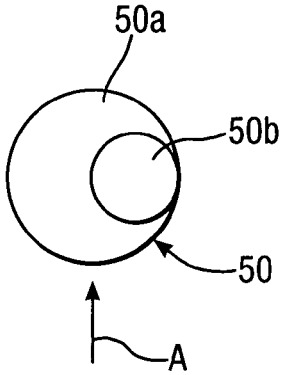
Figure 8D:
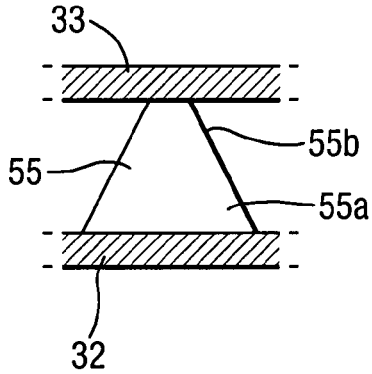

In FIG. 8*d*, an alternative pedestal 55 comprises a tapering shape between wall 32 and wall 33. This shape may be preferable where the whole pedestal is formed on one half of the mould and is therefore a preferred shape having no re-entrant or step features. Alternate tapering pedestals 55 extend from either wall 32 or 33.

Figure 8E:
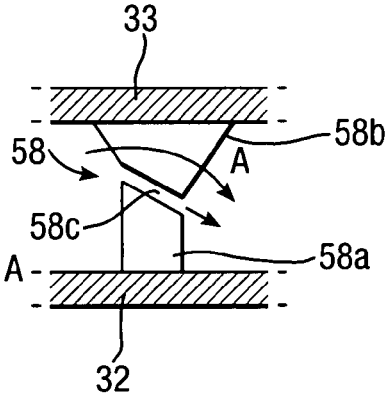
Figure 8F:
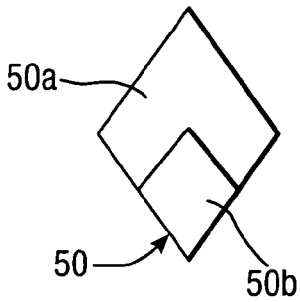

In FIG. 8*e*, another alternative pedestal 58 comprises a tapering part 58*b* extending from wall 33 and a cylindrical part 58*a* extending from wall 32. The two parts define a gap 58*c* therebetween, which is angled downwards to direct coolant downwardly and create further beneficial turbulence to improve mixing between the walls. Of course the parts 58*a* and 58*b* may be any cross-sectional shape.

Referring to FIGS. 9 and 10, a pedestal 59 in an array of pedestals comprises two elongate parts 59*a*, 59*b*, each part in this example being elliptical in cross-sectional shape and having a first and a second axes 60, 61. The first axis 60 is along the larger dimension of the part e.g. 59*b*. The pedestal 59 is arranged such that the first axis 60 of one part 59*a* is normal to the first axis 60 of the other part 59*b*. As shown in the figures, the row 56*r* has the first axis 60 of part 59*a*, adjacent wall 32, normal to the coolant flow direction A and the first axis 60 of part 59*b*, adjacent wall 33, parallel to the coolant flow direction A. Rows 55*r* and 57*r* have pedestals orientated at 90 degrees to those in row 56*r*. Although the overall cross-sectional areas of the parts 59*a*, 59*b* are similar to one another, due to their orientation and shape the coolant flow areas adjacent the two walls 32, 33 (i.e. between parts 59*b* of adjacent pedestals 59) change from row to row and thereby force the coolant to flow from one wall to the other and vice versa as described hereinbefore.

Referring to FIG. 11, the present invention may also be utilised to accommodate cooling holes 70 defined through the wall 32. The pedestal 50 upstream of the cooling hole 70 has both parts with their leading edges 62 aligned and the downstream pedestal has both parts with their trailing edges 64 aligned, then the space between the half pedestals 50*b* will be larger than otherwise. This enlarged gap when arranged on the pressure side wall 32 of aerofoils 30 is used to accommodate a row of film cooling holes 70, without the need to drill or laser through any pedestals 50. Not only does this arrangement simplify any hole drilling process, but also preventing loss of pedestals means that local thermal hot spots do not occur where pedestals have been destroyed.

An advantage of having at least one adjacent pedestal arranged such that its smaller cross-sectional area part 50*b* is adjacent the hole 49 is that greater space is provided to accommodate an array of cooling holes 42, only one cooling hole 42 being shown. In conventional aerofoils the cooling hole 42 position would result in the absence of the entire pedestal 50. A further advantage is that the cooling gas flow around the smaller part-pedestal 50*b* is less turbulent so that the gas may better enter the cooling hole 42 and improve the cooling film on an external surface 44 of the aerofoil 30. Thus although less heat will be removed by the smaller diameter part-pedestal 50*b*, the improvement to the cooling film overall improves the cooling of the component 30.

Referring back to FIG. 1, the combustor 15 is constituted by an annular combustion chamber 20 having radially inner and outer double wall structures 21 and 22 respectively. Similarly to the turbine blade 30, each of the combustor's double walls 21, 22 have two walls 32, 33 and an array of pedestals 50 disposed therebetween. The array of pedestals 50 is in accordance with any of the embodiments of the present invention described above.

It should be appreciated by the skilled artisan that any number of the pedestal shapes described herein may be combined and geometries that would become possible is almost endless and too numerous to describe here. However, the principle benefits of the pedestal arrangements are: increased levels of heat transfer from the walls, improved mixing and therefore a more even coolant temperature, the ability to tailor the individual heat loads on each wall independently and the ability to use differing levels of blockage to counter adverse pressure gradients along successive rows of pedestals.

Also it should be appreciated by the skilled addressee that each pedestal 50 may be formed completely on one wall 32, 33 or that the length of each part-pedestal 50*a*, 50*b* may vary and not be an exact half the full length of the pedestal.

I claim:

1. A component for a gas turbine engine comprising a first wall and a second wall defining a coolant passage and an array of pedestals extending between the first wall and the second wall wherein at least one pedestal changes in cross-section between the first wall and the second wall, the pedestal(s) includes a first part having a first cross-sectional area and a second part having a second cross sectional area, and the first part and the second part are aligned at a common trailing edge.

2. A component as claimed in claim 1 wherein the pedestal (s) tapers.

3. A component as claimed in claim 1 wherein the first cross-sectional area is greater than the second cross sectional area.

4. A component as claimed in claim 1 wherein in a first row of pedestals at least two of the pedestals have their greater cross sectional area adjacent the first wall.

5. A component as claimed in claim 4 wherein an array of pedestals comprises alternating first and second rows of pedestals.

6. A component as claimed in claim 4 wherein the pedestals in the first row are in-line with the second row of pedestals with respect to the direction of coolant flow.

7. A component as claimed in claim 4 wherein the pedestals in the first row are staggered with respect to the second row of pedestals with respect to the direction of coolant flow.

8. A component as claimed in claim 1 wherein in a second row of pedestals at least two of the pedestals have their greater cross sectional area adjacent the second wall.

9. A component as claimed in claim 1 wherein the wall defines a hole for the passage of coolant therethrough and at least one adjacent pedestal is arranged such that its smaller cross-sectional area part is adjacent the hole.

10. A component as claimed in claim 1 wherein the two parts of each pedestal are selected from the group comprising the cross-sectional shapes of circular, triangular, rectangular, diamond, parallelepiped and ellipse.

11. A component as claimed in claim 10 wherein the two parts have the same cross-sectional shape.

12. A component as claimed in claim 11 wherein a second axis of one part is not aligned with a second axis of the other part.

13. A component as claimed in claim 1 wherein the component is a blade or vane of a turbine or a compressor of a gas turbine engine.

14. A component as claimed in claim 1 wherein the component is a wall of a combustor of a gas turbine engine.

15. A component for a gas turbine engine comprising a first wall and a second wall defining a coolant passage and an array of pedestals extending between the first wall and the second wall wherein at least one pedestal changes in cross-section between the first wall and the second wall, and in a first row of pedestals at least two of the pedestals alternate between having their greater cross sectional area adjacent the first wall and their smaller cross sectional area adjacent the first wall.

16. A component as claimed in claim 15 wherein in a second row of pedestals at least two of the pedestals alternate between having their greater cross sectional area adjacent the second wall and their smaller cross sectional area adjacent the second wall.

17. A component as claimed in claim 15 wherein the first and second rows are offset from one another so that in the downstream direction of the coolant the greater cross sectional area alternates between adjacent the first wall and the second wall.

18. A component for a gas turbine engine comprising a first wall and a second wall defining a coolant passage and an array of pedestals extending between the first wall and the second wall wherein at least one pedestal changes in cross-section between the first wall and the second wall, two parts of each pedestal are selected from the group comprising the cross-sectional shapes of circular, triangular, rectangular, diamond, parallelepiped and ellipse, and the two parts have different cross-sectional shapes.

19. A component as claimed in claim 18 wherein the first part and the second part are concentric.

20. A component as claimed in claim 18 wherein the first part and the second part are aligned at a common leading edge.

* * * * *